US005645966A

United States Patent [19]

Koga

[11] Patent Number: 5,645,966

[45] Date of Patent: Jul. 8, 1997

[54] IMAGE FORMING METHOD

[75] Inventor: Yoshiro Koga, Nagano, Japan

[73] Assignee: Seiko Epson Corporation, Tokyo, Japan

[21] Appl. No.: 513,089

[22] Filed: Aug. 9, 1995

Related U.S. Application Data

[63] Continuation of Ser. No. 159,630, Dec. 1, 1993, Pat. No. 5,467,174.

[30] Foreign Application Priority Data

| | | | |
|---|---|---|---|
| Dec. 3, 1992 | [JP] | Japan | 4-324439 |
| Aug. 24, 1993 | [JP] | Japan | 5-209666 |

[51] Int. Cl.[6] ..... G03G 13/16

[52] U.S. Cl. ..... 430/101; 430/126

[58] Field of Search ..... 430/126, 110, 430/106, 101

[56] References Cited

U.S. PATENT DOCUMENTS

| | | | |
|---|---|---|---|
| 4,137,188 | 1/1979 | Uetake et al. . | |
| 4,284,701 | 8/1981 | Abbott et al. . | |
| 4,335,196 | 6/1982 | Ohmuro et al. . | |
| 4,407,925 | 10/1983 | Liebman . | |
| 5,066,558 | 11/1991 | Hikaki et al. . | |
| 5,085,963 | 2/1992 | Suzuki et al. . | |
| 5,120,631 | 6/1992 | Kanbayashi et al. . | |
| 5,219,694 | 6/1993 | Anno et al. . | |
| 5,437,955 | 8/1995 | Michlin | 430/110 |
| 5,447,815 | 9/1995 | Kato et al. | 430/126 |

FOREIGN PATENT DOCUMENTS

| | | |
|---|---|---|
| 0004748A2 | 10/1979 | European Pat. Off. . |
| 0203818A2 | 12/1986 | European Pat. Off. . |
| 0335676 | 10/1989 | European Pat. Off. . |
| 0365344 | 4/1990 | European Pat. Off. . |
| 0430674A1 | 6/1991 | European Pat. Off. . |
| 0435608 | 7/1991 | European Pat. Off. . |
| 0482665 | 4/1992 | European Pat. Off. . |
| 0574853A2 | 12/1993 | European Pat. Off. . |
| 63-279261 | 11/1988 | Japan . |
| 2262160 | 10/1990 | Japan . |
| 2304580 | 12/1990 | Japan . |
| 3121462 | 5/1991 | Japan . |
| 3293364 | 12/1991 | Japan . |
| 4107478 | 4/1992 | Japan . |
| 4143775 | 5/1992 | Japan . |
| 1442835 | 7/1976 | United Kingdom . |
| 2104841 | 3/1983 | United Kingdom . |
| 2114310 | 8/1983 | United Kingdom . |
| 2234602 | 2/1991 | United Kingdom . |
| 2245376 | 1/1992 | United Kingdom . |

OTHER PUBLICATIONS

Patent abstract of Japan, Col. 13, No. 98, p. 31 and JP 63–279261 A (Toshiba).

*Primary Examiner*—John Goodrow

*Attorney, Agent, or Firm*—Sughrue, Mion, Zinn, Macpeak & Seas

[57] ABSTRACT

The improved image forming method reduces the chance of toner particles of adhering or filming on the surfaces of impression members, thereby enabling the formation of high-resolution image in a consistent and reliable manner. The method uses a charging member 4 for contact charging a latent image carrier 1, a developing member 11 for impression development of a pattern of latent electrostatic image, a transfer member 18 for impression transfer of the developed toner 10, and an impression cleaning member 23 for cleaning the latent image carrier 1 after toner transfer. The toner to be used satisfies one of the following conditions: that it should have an external additive added in an amount of 0.4 to 1.2 wt %; that it should have a volume resistivity of at least $10^{17}$ Ωcm; that it should incorporate a release agent in an amount no more than 5 wt %; or that it should not include large amounts of fine particles with a size of 5 μm and less, or coarse particles with a size of 12.7 μm and more.

14 Claims, 7 Drawing Sheets

IMAGE FORMING METHOD

This is a continuation of application Ser. No. 08/159,630 filed Dec. 1, 1993, now U.S. Pat. No. 5,467,174.

BACKGROUND OF THE INVENTION

This invention relates to a method of forming an image by electrophotographic processes. More particularly, the invention relates to an image forming method that is advantageous for implementing electrophotographic processes using contact charging and/or impression development and/or impression transfer and/or impression cleaning.

The prior art apparatuses for forming an image by electrophotographic processes have heretofore adopted corona charging and corona transfer, but the use of such corona treatments has caused adverse effects on the environment by the ozone they generate. Hence, in order to reduce the amount of ozone generation, the use of contact charging and contact transfer instead of the conventional corona charging and corona transfer is currently under review. The benefits of contact charging and corona transfer are not limited to the advantage that small amounts of noxious ozone are generated; they can also be performed at lower voltages than corona charging and corona transfer and, hence, can advantageously be operated on a smaller amount of power.

For instance, according to the teaching of Unexamined Published Japanese Patent Application (kokai) No. Hei 3-293364, a release coat is provided on a contact charging member so as to prevent the filming of a toner on the latter; at the same time, the polyester base constituent of the toner is substituted by a N-containing radical, and a fluidity improving agent of low chargeability is externally added to the toner so as to prevent the saturation of the toner with charges, to improve its cleanability, and to prevent its filming on the contact charging member.

However, the volume average particle size of the toner used in this prior art technique is very small (≦10 μm). Therefore, if the amount of the external additive is increased up to about 2 wt % with a view to improving the flowability of the toner, only the external additive will pass uncaptured by an impression cleaning member such as a cleaning blade, and the adhering additive on the contact charging member will cause uneven charging, if not filming. This would make it impossible to create a desired pattern of a latent electrostatic image.

According to another prior art technique, such as the one described in Unexamined Published Japanese Patent Application (kokai) No. Hei 1-195459, a fluidity imparting agent such as hydrophobic silica is added externally to a toner, which is then used to improve the cleanability of a contact transfer roller.

However, not all toner particles that contact the impression transfer member in a non-papering mode will have the same polarity, and the particles that are picked up by the transfer roller under the applied cleaning bias will smudge the back side of the paper to be supplied in the next copy cycle. This phenomenon takes place not only due to the charging polarity of the toner but also in the case where the electric resistance of the toner is low enough to be susceptible to charge injection.

Unexamined Published Japanese Patent Application (kokai) No. Hei 3-121462 proposes that fine particles treated with silicone oil or silicone varnish be externally added in an amount of 0.05 to 3 parts by weight to 100 parts by weight of a toner, whereby the occurrence of "white void" is suppressed during contact transfer.

However, if the fine particles are added in amounts up to about 2 parts by weight, only the external additive will pass uncaptured by an impression cleaning member, such as a cleaning blade, and the adhering additive on the contact charging member will cause uneven charging, if not filming, and thereby make it impossible to create a desired pattern of a latent electrostatic image. As a further problem, an attempt to form an image by impression development will cause a developer fog if it is made under hot and humid conditions or if many prints are copied.

As the demand for higher resolution in an image has increased today, efforts are being made to reduce the size of toner particles, and, at the same time, apparatuses have been proposed that adopt a one-component nonmagnetic impression development method for enhancing the effect of a development electrode by minimizing the space for development.

For example, Unexamined Published Japanese Patent Application (kokai) No. Sho 63-279261 teaches a toner particle size distribution profile that permits rapid charging of the toner even if it is composed of small particles, and Unexamined Published Japanese Patent Application (kokai) No. Hei 2-262160 teaches a method of forming a fineline image by impression development using a toner whose 50% volume average particle size is no more than 8 μm.

However, these prior art techniques have the disadvantage that fine toner particles no larger than 5 μm, agglomerated toner particles or the external additive that has come off the toner particles, will adhere to the development member or the latent image carrier and appear as fog or white spots in the image. This phenomenon takes place not only due to the charging polarity of the toner but also in the case where the electric resistance of the toner is low enough to be susceptible to charge injection.

SUMMARY OF THE INVENTION

In the above-described prior art techniques, the separation of the external additive from the toner, the flowability of the toner, electric resistance of the toner, the bleed-out of the release agent from the toner, the presence of tiny or coarse toner particles, and various other factors have prevented the charging member, developing member, transfer member, or cleaning member from performing their function to the fullest extent when they are pressed into contact with the latent image carrier, thereby deteriorating the image quality and, hence, lowering the operational reliability of the image forming apparatus.

The present invention has been accomplished under these circumstances and has as an object providing a method by which the deposition or filming of toner particles on various impression members is sufficiently reduced to enable the consistent formation of high-resolution images.

Another object of the present invention is to provide an image forming method which is substantially free from the problem of fluctuations in the charges on the toner in various areas of impression, thereby reducing the likelihood of deterioration in image quality such as fogging.

Still another object of the present invention is to provide a method by which the bleed-out of foreign matter from the toner, as well as the deposition or filming of toner particles on various impression members or the latent image carrier are sufficiently reduced to insure the consistent formation of high-resolution images.

A further object of the present invention is to provide an image forming method that improves the cleanability of the toner while reducing fogging.

Yet another object of the present invention is to provide a method that forms an image by the charging, development, transfer, and cleaning steps using impression members and which can be implemented with a compact apparatus to assure high operational reliability.

These objects of the present invention can be achieved by an image forming method that forms a toner image on a recording medium by an electrophotographic process using a contact charging member which contacts a latent image carrier to charge it to a predetermined potential, exposure means which illuminates said latent image carrier with light to form a pattern of a latent electrostatic image, a developing member that imparts a toner to said pattern of the latent electrostatic image to render it visible, an impression transfer member that is provided in such a way that it is pressed into contact with the latent image carrier and which transfers the developed toner to the recording medium, and a cleaning member that is pressed into contact with the latent image carrier to remove the toner that remains on it after transfer, which method is characterized in that the toner comprises matrix resin particles having an external additive added in an amount of 0.4 to 1.6 wt %.

The objects of the present invention can also be attained by an image forming method that forms a toner image on a recording medium by an electrophotographic process using a charging member for charging a latent image carrier to a predetermined potential, exposure means which illuminates said latent image carrier with light to form a pattern of a latent electrostatic image, an impression development member that is provided in such a way that it is pressed into contact with the latent image carrier and which imparts a toner to said pattern of the latent electrostatic image to render it visible, and an impression transfer member that is provided in such a way that it is pressed into contact with the latent image carrier and which transfers the developed toner to the recording medium, which method is characterized in that the toner has a volume resistivity of at least $10^{17}$ Ωcm.

The objects of the present invention can also be attained by an image forming method that forms a toner image on a recording medium by an electrophotographic process using a charging mender for charging a latent image carrier to a predetermined potential, exposure means which illuminates said latent image carrier with light to form a pattern of a latent electrostatic image, a developing member that is provided in such a way that is pressed into contact with the latent image carrier and which imparts a toner to said pattern of the latent electrostatic image to render it visible, a transfer member which transfers the developed toner to the recording medium, and a cleaning member which is pressed into contact with the latent image carrier to remove the toner that remains on it after transfer, which method is characterized in that the toner comprises matrix resin particles having a release agent added internally in an amount ranging from 1 to 5 wt %.

The objects of the present invention can also be achieved by an image forming method that forms a toner image on a recording medium by an electrophotographic process using a contact charging member which contacts a latent image carrier to charge it to a predetermined potential, exposure means which illuminates said latent image carrier with light to from a pattern of a latent electrostatic image, a developing member that is provided in such a way that it is pressed into contact with the latent image carrier and which imparts a toner to the pattern of the latent electrostatic image to render it visible, an impression transfer member that is provided in such a way that it is pressed into contact with the latent image carrier and which transfers the developed toner to the recording medium, and a cleaning member which is pressed into contact with the latent image carrier to remove the toner that remains on it after transfer, which method is characterized in that the toner has a volume average particle size of 6 to 10 μm, with the percentage by number of toner particles not larger than 5 μm being no more than 15% and the percentage by number of toner particles no smaller than 12.7 μm being no more than 5%.

According to the first image forming method of the present invention which includes the steps of contact charging and contact transfer, the toner has an external additive added to matrix resin particles in an amount of 0.4 to 1.6 wt %, thereby imparting a desired degree of fluidity to the toner. Since the chance of a malfunction of the charging member is sufficiently reduced to prevent uneven charging, the otherwise occurring fogging is suppressed and the transfer efficiency is sufficiently increased. This increased efficiency not only reduces the frequency of incomplete toner transfer but also eliminate the occurrence of defective transfer, thereby insuring the formation of high-resolution images.

In a preferred embodiment of this method, which includes the steps of contact charging, impression development, and contact transfer, the external additive is added to the matrix resin particles in an amount of 0.4 to 1.2 wt %. and this is effective in reducing the deposition of the external additive on the impression development member. As a result, the occurrence of toner particles of reverse polarity is effectively prevented to reduce the chance of deterioration in image quality due to fogging or the back-side scum which would otherwise occur during toner transfer.

According to the second image forming method of the present invention, the electric resistance of the toner is sufficiently enhanced so that it will not lose charges but maintain a predetermined polarity even if it is placed in a high electric field during impression development or impression transfer. As a result, both development efficiency and transfer efficiency are enhanced, whereby the occurrence of fogging during development and dusting of the toner during transfer are sufficiently reduced to insure the consistent formation of high-resolution images.

According to the third image forming method of the present invention, the amount of the release agent incorporated (added internally) in the toner is controlled to be within a predetermined range. This not only prevents the filming of toner which would otherwise occur in various parts of impression but also suppresses the "white void" which would otherwise occur in the transfer step, whereby high-resolution images can be formed in a consistent manner.

According to the fourth image forming method of the present invention, the particle size distribution of the toner is rendered sharp enough to reduce the occurrence of tiny or coarse toner particles, thus insuring that no toner particles will pass uncaptured in various areas of impression while preventing the occurrence of toner clogging or filming in those areas of impression. At the same time, the developer fog which would otherwise occur due to poorly charged toner particles is reduced, and the transfer efficiency is sufficiently improved to insure consistent formation of high-resolution, images.

DETAILED DESCRIPTION OF THE INVENTION

Figure 1:
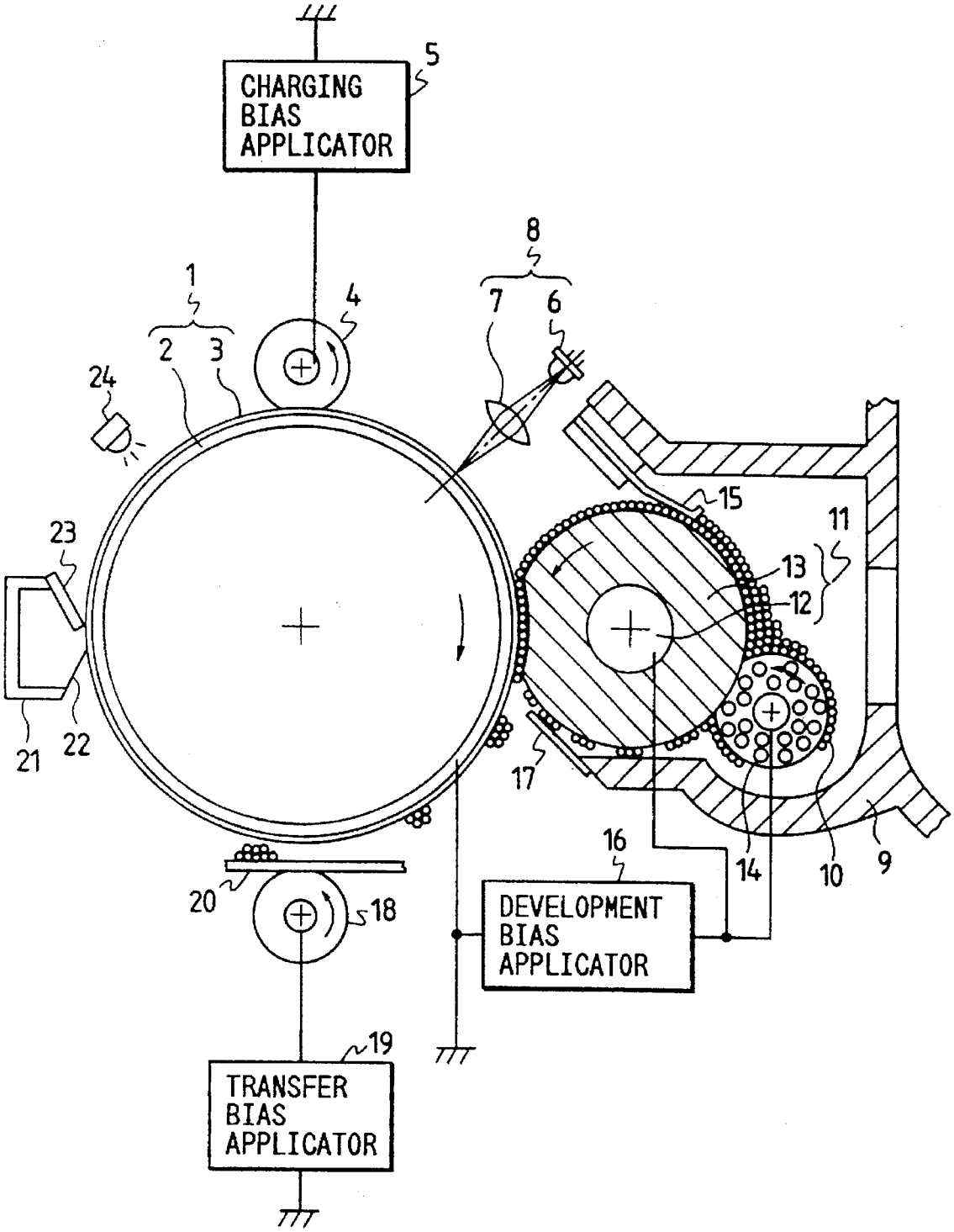
FIG. 1 is a cross-sectional view of an image forming apparatus that may be used to implement an image forming method according to an embodiment of the present invention.

FIG. 1 is a cross-sectional view of an image forming apparatus that may be used to implement an image forming method according to a first embodiment of the present invention. Referring to FIG. 1, a latent image carrier 1 comprises an electroconductive support 2 as overlaid with an organic or inorganic light-sensitive layer 3 having photoconductivity. A charging member 4 is pressed into contact with the latent image carrier 1 under a light load of about a few gf/mm as a voltage is applied to the charging member 4 by a charging bias applicator 5 so that the light-sensitive layer 3 is charged to a predetermined potential. The charging member 4 may be a charging roller that is loaded with an elastic member such as a spring or a charging blade that is elastic in itself. With the latent image carrier 1 thus electrified, it is subsequently given a contrast in potential to form a pattern of latent electrostatic image by exposure means 8, in which light issuing from a light source 6 such as a laser or LED is guided through imaging optics 7 to give selective imagewise illumination over the light-sensitive layer 3. The optics 7 may be scanning optics using a plurality of lenses and a polygonal scanner or size-for-size imaging optics using an optical fiber array. The apparatus shown in FIG. 1 also includes a development unit 9 which transports and develops a toner 10. The toner is transported specifically by a developing member 11 which comprises a shaft 12 that is surrounded concentrically with an electroconductive elastic member 13. The toner 10; as supplied to the developing member 11 by a supply member 14, is retained on the developing member 11 and is regulated by a guide member 15 to form a thin layer of suitable thickness. The guide member 15 is a plate that is formed of a nonmagnetic or magnetic metal or a resin. As the developing member 11 is rotated, the thin layer of toner 10 is transported to the developing section. The developing member 11 is pressed against the latent image carrier 1 at a predetermined pressure. Therefore, when the toner 10 is transported to the developing section where the latent image carrier 1 contacts the developing member 11, the toner 10, that has been electrified in accordance with the potential contrast on the latent image carrier 1 and with the development field created by a development bias applicator 16, is transferred to the latent image carrier 1. Consequently, the latent electrostatic image pattern becomes visible. A sealing member 17 is provided at the opening of the development unit 9; the sealing member 17, which makes light contact with the developing member 11, prevents the toner particles not only from dropping after development but also from dusting from within the development unit 9. A transfer member 18 such as a transfer roller or a transfer belt is loaded with an elastic member such as a spring and pressed into contact with the latent image carrier 1 under a light load of about a few gf/mm. A transfer bias applicator 19 applies a voltage to the transfer member 18 so that the developed toner 10 is transferred from the latent image carrier 1 onto a recording medium 20. The toner transferred onto the recording medium 20 is fixed by heat or pressure to produce a desired image on the medium 20. After the end of transfer, the latent image carrier 1 rotates to reach a cleaning unit 21, in which an inlet sealing member 22 is brought into light contact with the latent image carrier 1 to prevent the dusting of toner particles while, at the same time, a cleaning member 23, that is typically in the form of a resin blade and which is pressed into contact with the latent image carrier 1, rejects the residual toner and any foreign matter that may have been deposited on the surface of the latent image carrier 1. Thereafter, any unwanted charges on the latent image carrier 1 are removed by an erase unit 24 so that it is ready for another copy cycle. The above-described process is repeated as many times as required to perform continuous image formation. If desired, the toner particles recovered by the cleaning unit 21 may be supplied again into the development unit 9 so that toner recycling is achieved.

A further discussion is made of the charging member 4. The charging member 4 comprises a metal shaft coated with an electroconductive rubber layer which, in turn, is provided on the periphery with a high-resistance layer. This double-layer roller is pressed into contact with the latent image carrier 1 at a linear pressure of a few gf/mm and, by means of discharge or charge injection, the latent image carrier 1 is charged to a predetermined potential. The charging bias depends on the voltage at which the latent image carrier 1 is to be charged. If it is to be charged to a negative voltage of 600 V, a voltage of −1170 V is applied as the charge bias (−1170 V is the sum of −600 V and −570 V which is the discharge start voltage). If an ac component is to be superposed, an ac voltage of about ±600 V is superposed on the above-mentioned dc component. The charging member 4 may be rotated either at the same peripheral speed or a different peripheral speed than the latent image carrier 1 or, if desired, the charging member 4 may be fixed. It should be noted here that the charging member 4 must satisfy various conditions. In addition to the need that the external additive on the toner should not readily adhere to its surface, the charging member 4 should not foul the latent image carrier 1, should not be very sticky, should not wear rapidly, and should have a smooth enough surface to provide effective contact with the latent image carrier 1. Other forms of the charging member 4 that may be used include: a single-layer elastic conductive roller in which a single-layer conductive rubber layer is provided with a resistance distribution such that the electric resistance will increase from the center outward (towards the surface); a multi-layered elastic conductive roller which, in addition to the resistance layer just described above, is furnished with an anti-bleed layer, a resistance adjusting layer, a protective layer, etc.; an elastic conductive roller that uses a foamed member that experiences less variations in resistance; a film or elastic member that has a high-resistance resin layer formed on top of a thin metal sheet; an elastic conductive film formed of a high-resistance resin; and an elastic conductive brush such as a fur brush. All of these examples are capable of charging the latent image carrier 1 to a predetermined potential. The electric resistance of the charging member 4 is worth particular mention. If it is adapted to have values of $10^6$ to $10^9$ Ω in terms of the resistance as measured by the method illustrated in FIG. 2, there will be no overcurrent flowing through pinholes that might form in the latent image carrier 1, and, in various environments ranging from a hot and humid atmosphere to a cold and dry atmosphere, the time constant of the charging circuit can be so controlled as to insure a sufficient charging time to accomplish charging with reduced unevenness.

Figure 2:
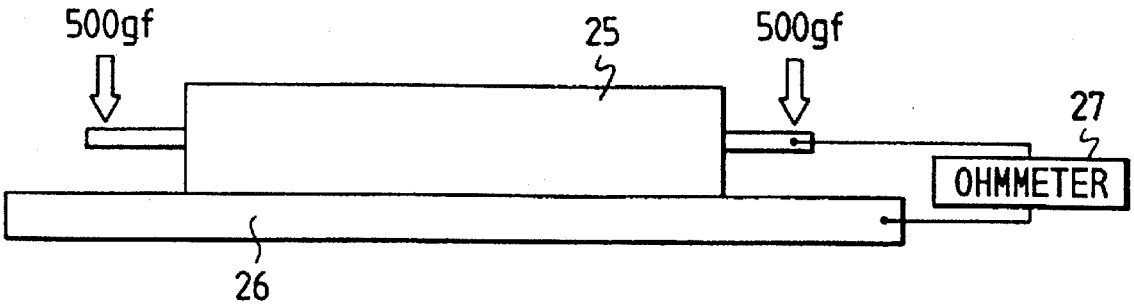
FIG. 2 is a diagram showing how the electric resistance of a roller can be measured.

We now describe the method of measuring the electric resistance of a roller with reference to FIG. 2. The roller indicated by 25 in FIG. 2 is pressed against a conductive plate 26 with a load of 500 gf being exerted at each end of the shaft. An ohmmeter 27 is connected between the shaft of the roller 25 and the conductive plate 26 so that it can measure the resistance of the roller 25. It should be noted here that a dc voltage of 10 V is applied during resistance measurement.

A further discussion is also made of the developing member 11. It should be elastic at least on the surface so that it can be pressed into contact with the latent image carrier 1 at a linear pressure of 0.5 to 10 gf/mm. An elastic conductive roller having a conductive rubber layer provided around a metal shaft is preferred for the purpose of insuring that it is held in constant-pressure contact with the latent image carrier 1. The development bias voltage should be determined on a case-by-case basis. If the latent image carrier 1 has a potential of −600 V in the non-exposed area and a potential of −100 V in the exposed area, a voltage intermediate between the two values may be applied. When using a nonmagnetic toner, a dc development bias voltage between −200 V and −300 V may be applied, and if a magnetic toner is to be used, a dc development bias voltage between −250 V and −450 V may be applied. If an ac component is to be superposed, an ac voltage of about ±500 V with a frequency of about 1 Khz may be superposed on the above-mentioned dc component. The developing member 11 is desirably rotated at a different peripheral speed than the latent image carrier 1 so as to prevent the fogging of the non-image area while insuring that the amount of saturated development will be no more than a predetermined level. Further, the developing member 11 must satisfy various requirements as exemplified by the following: it should lower the adhesion of the external additive on the toner so that the latter can be charged consistently; its triboelectric series should be such that the toner can be charged to a desired polarity; the toner should be transported consistently; the development member 11 should not foul the toner; it should not foul the latent image carrier 1; it should not be highly sticky; it will not wear rapidly; and it should have a smooth enough surface to provide effective contact with the latent image carrier 1 by way of the toner. The developing member 11 is in no way limited to the single-layered elastic conductive roller. It may also be a multi-layered elastic conductive roller which includes a triboelectric layer, a magnetic field generating layer, an anti-bleed layer, a resistance adjusting layer, a protective layer, etc. or an elastic conductive brush such as a fur brush. These examples of the developing member 11 are capable of maintaining stable contact with the latent image carrier 1 so as to form high-resolution images. If the toner supply is such that ghosts are produced in the printing process, two approaches may selectively be taken to deal with this problem. One is to have an elastic supply roller contact the developing member 11 in the as-developed position for supplying and stripping the toner, and the other is to apply either a bias voltage to the guide member 15 or supply member 14 for accelerating the toner's supply and electrification or to render these members equipotential with the developing member 11. The toner particles as supplied to the developing member 11 will pass under the guide member 15 so that they are charged by friction to form one or two thin layers uniformly. (Since the toner has a volume average particle size ranging from several to about 10 μm, the thickness of the toner layer will be about 10 μm). The thin layers are then transported to the developing section, where the pattern of the latent electrostatic image is rendered visible with a predetermined amount of development toner in accordance with the applied developing bias voltage. In order to insure that the normal development bias voltage is applied without causing delay in development and to accomplish printing at high resolution under the effect of the development electrode, the electric resistance of the developing member 11, as measured by the method shown in FIG. 2, requires a very small time constant for causing the developing current to flow. This requirement is due to the fact that the development nip is only about 1 mm wide in order to finish development within a short time. Thus, in order to realize a printing speed up to about 20 PPM, the developing member 11 desirably has an electric resistance of up to $10^9$ Ω. It should, however, be noted that the value of resistance is in no way limited to $10^9$ Ω and less, because a high-resistance or even dielectric toner carrier having higher resistances may be used in continued printing by adding an erase mechanism for neutralizing any residual charges on the toner carrier.

A further discussion of the transfer member 18 is made below. The transfer member 18 is typically an elastic conductive roller that has a conductive foamed layer provided around a metal shaft, and it is to be urged against the latent image carrier 1 via the recording medium 20 so that the two are held in stable contact with each other at a linear pressure of a few gf/mm. The transfer bias voltage also depends on the case, circumstances of each and a voltage ranging from +600 V to +2000 V may be applied. If the transfer member 18 is in direct contact with the latent image carrier 1, the transfer bias is turned off, or, alternatively, a cleaning bias of about −800 V may be applied. The transfer member 18 should preferably be rotated at generally the same peripheral speed as the latent image carrier 1. It should also be mentioned that the transfer member must satisfy various conditions. In addition to the need that the toner should not readily adhere to its surface, the transfer member 18 should not foul the latent image carrier 1, should not be very sticky, should not wear rapidly, and should have a smooth enough surface to provide effective contact with the latent image carrier 1. Other forms of the transfer member 18 that may be used include: a single-layer elastic conductive roller using a conductive foamed member with a skin, and a multi-layered elastic conductive roller provided with an anti-bleed layer, a resistance adjusting layer, a protective layer, etc. These rollers will bring the recording medium 20 into intimate contact with the latent image carrier 1, thereby producing a transferred image of high resolution without suffering from the problems of toner dusting and white void. Again, the electric resistance of the transfer member 18 is worth particular mention. If it is adapted to have values of $10^5$ to $10^8$ Ω in terms of the resistance as measured by the method illustrated in FIG. 2, the time constant of the transfer circuit can be controlled as to insure a sufficient transfer time to accomplish satisfactory transfer in various environments ranging from a hot and humid atmosphere to a cold and dry atmosphere. Furthermore, the transfer bias can be reduced to the lowest possible level, thereby minimizing the occurrence of memories due to the transfer of the latent electrostatic image pattern. It should be mentioned that the application of the transfer bias voltage is in no way limited to the above-described method of applying a constant voltage, and, alternatively, a constant current may be applied.

Next, the cleaning member 23 will be described in greater detail. The cleaning member 23 is such that the ridgeline of a blade typically made of a urethane resin is pressed into uniform contact with the latent image carrier 1 at a linear pressure of 1 to 40 gf/mm so as to remove mechanically the foreign matter on the carrier 1. In order to reduce the chance of the toner or its external additive of passing uncaptured by the cleaning member 23, the precision of the blade ridgeline, the contact angle, and pressure must be set at appropriate values. The precision of the blade ridgeline is preferably set to a value of about a few μm; the contact angle is preferably set at 10 to 45 degrees with respect to the line tangential to the area of contact with the latent image carrier 1; and the contact pressure is preferably set to a value of about 2 to 10 gf/mm.

The foregoing description of the image forming method of the present invention assumes that the development unit 9 performs impression development in which the developing member 11 is pressed into contact with the latent image carrier 1. If desired, an image may be formed by non-contact development with the developing member 11 being provided in such a way that it makes no contact with the latent image carrier 1.

Figure 8:
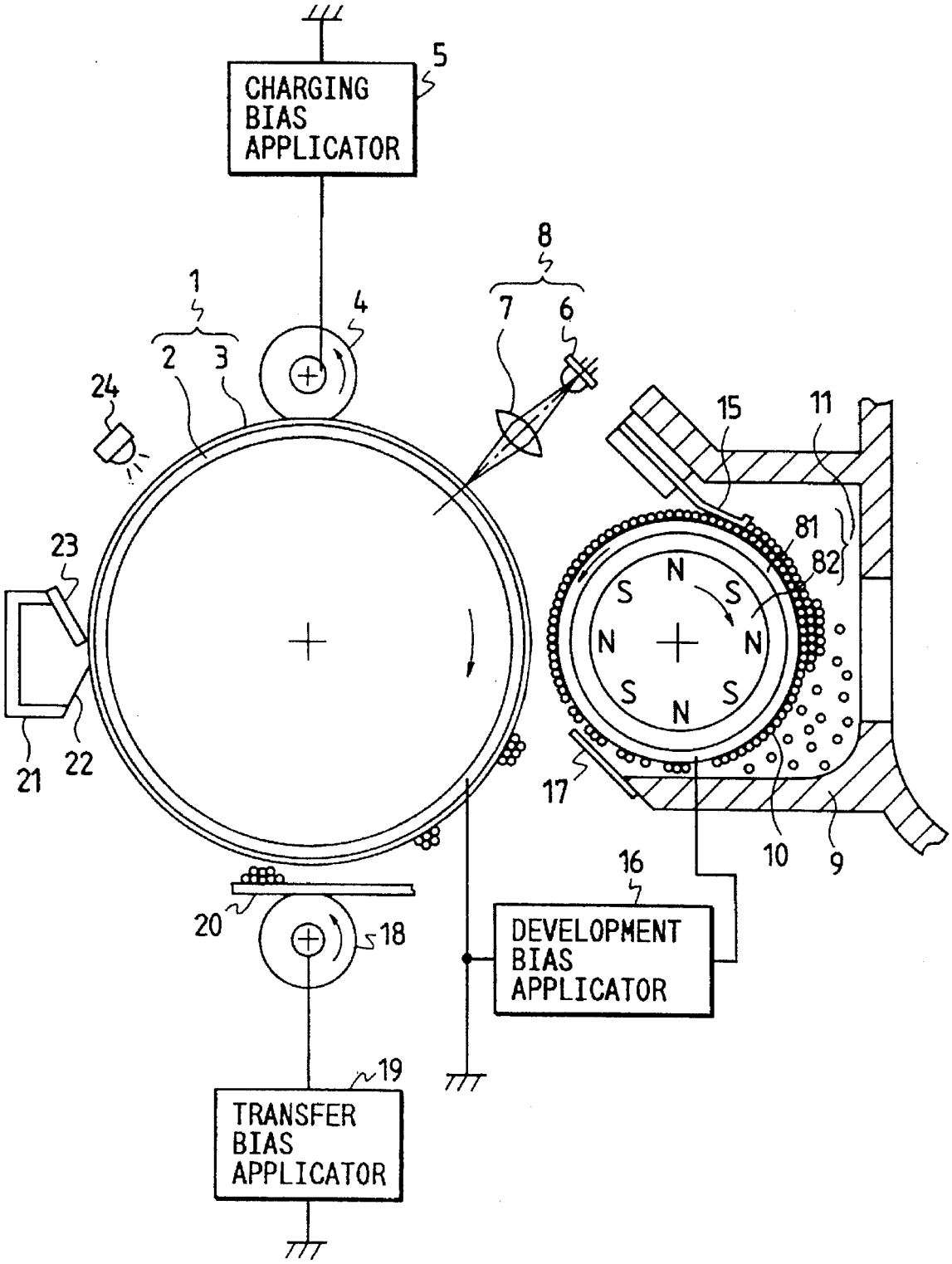
FIG. 8 is a cross-sectional view of an image forming apparatus that may be used to implement an image forming method according to another embodiment of the present invention.

FIG. 8 is a cross-sectional view of an image forming apparatus that may be used to implement an image forming method according to another embodiment of the present invention, in which non-contact development is performed. In FIG. 8, those members which perform substantially the same functions and which bear substantially the same names as the members shown in FIG. 1 are identified by like numerals and will not be described in detail. The development unit 9 transports and develops the toner 10. The developing member 11 which is responsible for the transfer of the toner 10 comprises a non-magnetic cylindrical sleeve 81 that contains a multipolar magnet (magnet roll 82) as a magnetic field generator and which is spaced from the latent image carrier 1 by a distance of 50 to 500 μm. The magnetic toner 10, as retained on the developing member 11 is regulated by the guide member 15 to form a thin layer of suitable thickness. The guide member 15 is a plate that is formed of a non-magnetic or magnetic metal or a resin. As the developing member 11, is rotated, the thin layer of toner 10 is supplied to the developing section. The magnet roll 82 may be rotating or stationary. Using the developing unit 9 having this construction offers the advantage of not only reducing the fogging that may occur during development but also preventing the deterioration of the latent image carrier 1 due to fouling by the developing member 11.

Experiments were conducted to form an image with the two types of image forming apparatus which have been described hereinabove. The results of these experiments are given below, as accompanied by further details about the toners used in the experiments.

EXAMPLE 1

Figure 3:
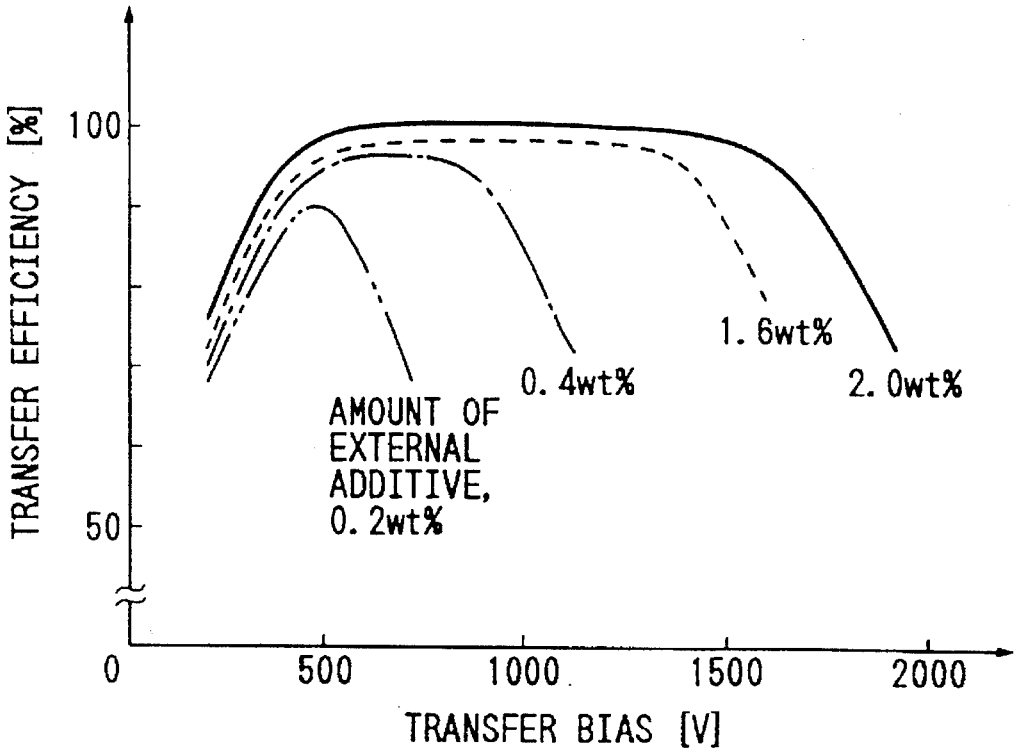
FIG. 3 is a graph showing the relationship between the transfer bias and the efficiency of impression transfer for varying amounts of the external additive in Example 1 of the present invention.
Figure 4:
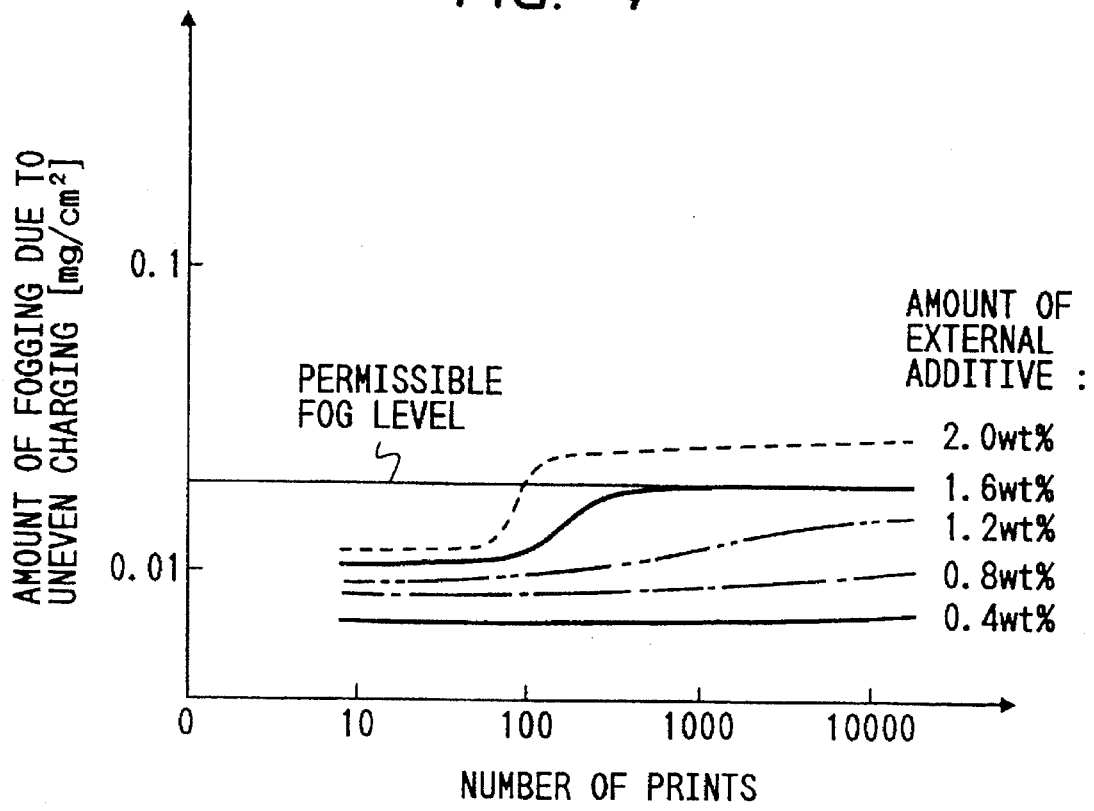
FIG. 4 is a graph showing the relationship between the number of prints and the amount of fog (on the latent image carrier) due to uneven charging for varying amounts of the external additive in Example 1 of the present invention.

Images were formed using an image forming apparatus of the type shown in FIG. 8. A change in the amount of the external additive in the toner causes a great change in the flowability of the toner. FIG. 3 shows the relationship between the transfer bias voltage and the efficiency of impression transfer at varying values of the amount of the external additive. As the amount of the external additive is increased, the voltage range over which high transfer efficiency is insured can be extended and the dusting of the toner during transfer can be reduced. When the fluidity of the toner used in the transfer process was enhanced, high transfer efficiency could be insured despite fluctuations in the transfer bias voltage and, the variations in the resistance of the transfer member could be absorbed effectively. However, excessively fluid toners or those toners from which the external additive would readily separate were likely to pass uncaptured by the cleaning member. Thus as the number of prints increased, the external additive and other foreign material adhered progressively to the surface of the contact charging member 4, and, eventually, local unevenness in the charging potential occurred, with some areas having high potential while some being entirely uncharged. FIG. 4 shows the relationship between the number of prints and the amount of fogging (on the latent image carrier 1) due to uneven charging at varying amounts of the external additive. As one can see from FIG. 4, when the amount of the external additive exceeded 1.6 wt %, local unevenness in charging occurred only after making a few hundred prints, producing the fog that was assumed to have been the result of deposition of toner particles of reverse polarity. The fogged toner did not contribute to image transfer, and, hence, deteriorated the transfer efficiency. This fogging occurred because tiny particles of the external additive which passed uncaptured by the cleaning member 23 were electrostatically attracted by the contact charging member 4. Thus, it became clear that there is an upper limit on the amount of the external additive that could be effectively added. A further problem that occurred when the amount of the external additive exceeded 1.6 wt % was that electrostatic offset occurred during fixing. This caused ghost-like scum on the final image. On the basis of these facts, it was verified that by adjusting the amount of the external additive to lie within the range from 0.4 to 1.6 wt %, the transfer bias was given a large tolerance for fluctuations, and continued image formation by printing could be accomplished without causing unevenness in charging or electrostatic offset during fixing.

EXAMPLE 2

Figure 9:
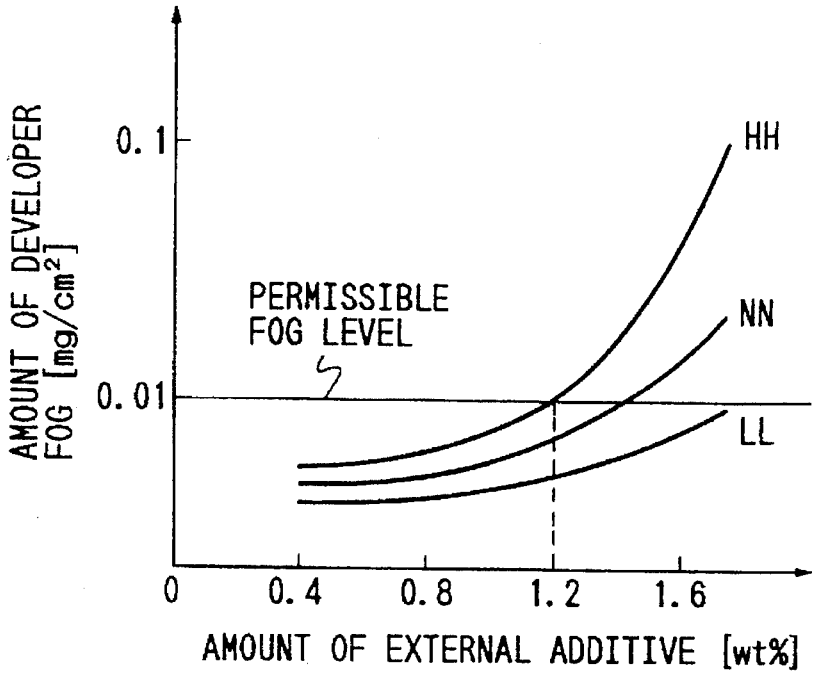
FIG. 9 is a graph showing the relationship between the amount of the external additive and the amount of developer fog that occurred under various conditions in Example 2 of the present invention.

Using an image forming apparatus of the type shown in FIG. 1, images were formed with varying amounts of the external additive on the toner. Image formation was conducted in three different environments: at ordinary temperature and humidity (25° C.×50%); in a cold and dry atmosphere (10° C.×15%); and in a hot and humid atmosphere (35° C.×65%). The observed relationship between the amount of the external additive in the toner and the amount of developer fog is shown in FIG. 9. As the temperature and humidity increased, more developer fog occurred. Under all environmental conditions tested, only the samples that used no more than 1.2 wt % of the external additive satisfied the permissible fog level. On the basis of these facts, it was verified that by adjusting the amount of the external additive to lie within the range from 0.4 to 1.2 wt % in the process comprising the steps of contact charging, impression development, impression transfer, and impression cleaning, the transfer bias was given a large tolerance for fluctuations, and continued image formation by printing could be accomplished without causing uneven charging or developer fog.

EXAMPLE 3

Figure 5:
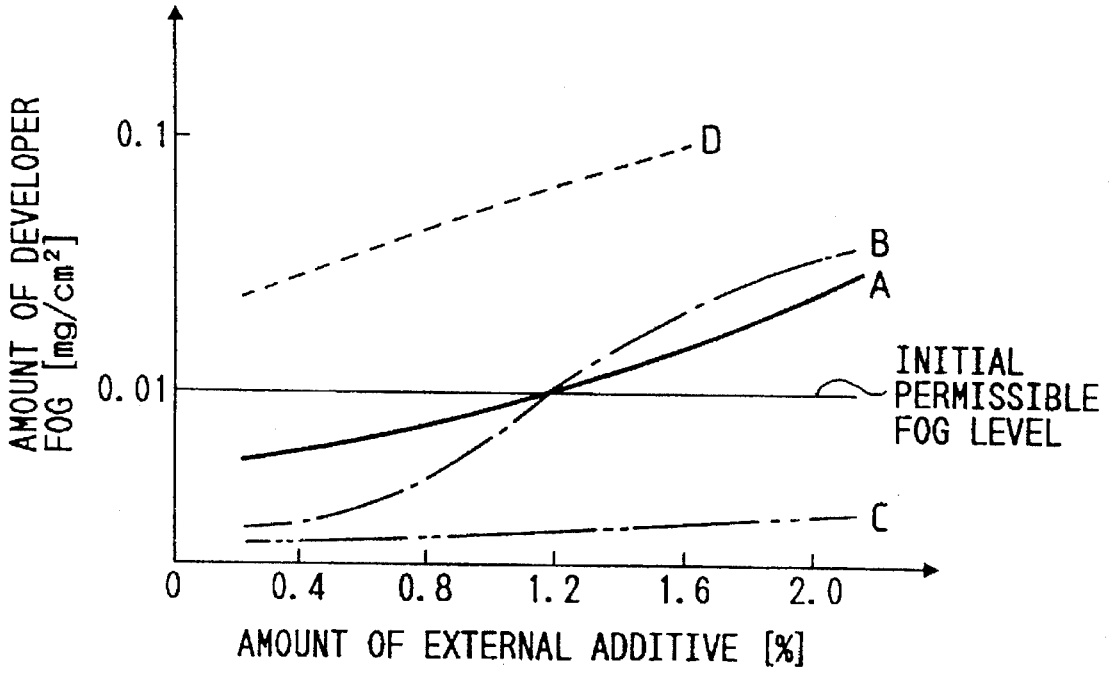
FIG. 5 is a graph showing the relationship between the amount of external additive and the amount of developer fog for four different kinds of external additive in Example 3 of the present invention.

Images were formed using an image forming apparatus of the type shown in FIG. 1. Four kinds of external additives, A, B, C and D, were used in the experiment. The relationship between the amount of each external additive and the amount of developer fog is shown in FIG. 5. External additive A was hydrophobic silica having an average size of ca. 10 nm for the primary particles; external additive B was hydrophobic silica of the same material as A except that it had an average size of ca. 16 nm for the primary particles; external additive C was hydrophobic silica which was identical to B except that the degree of its hydrophobicity was particularly high and; external additive D was hydrophobic silica having an average size of ca. 7 nm for the primary particles and the degree of its hydrophobicity was low. When the hydrophobic silica samples having average sizes of 10 nm and more for the primary particles were added externally to matrix resin particles for the toner in amounts not exceeding 1.2 wt %, the amount of developer fog that occurred in the initial period of printing operation could be held to a minimum. Thus, by forming images using impression development with the amount of the external additive being adjusted to lie within the range of 0.4 to 1.2 wt % and the average size of the primary particles in the external additive adjusted to 10 nm and more, the transfer bias was given a large tolerance for fluctuations, and prints could be made without suffering from uneven charging or developer fog. During continued printing, the adhesion of the external additive to the matrix resin particles of the toner was kept constant and defects such as burial of the additive in the matrix particles were entirely absent. No deterioration in image quality as a result of continued printing was discovered. On the basis of these facts, it was verified that by adjusting the amount of the external additive to lie within the range 0.4 to 1.2 wt % and by adjusting the average size of the primary particles in the external additive to 10 nm or more, continued printing could be done with high transfer efficiency and without experiencing uneven charging or fogging.

EXAMPLE 4

Using toners to which 0.4 to 1.2 wt % of various grades of hydrophobic silica (R972, R974, R202 and R812, all trade names of Nippon Aerosil Co., Ltd.; and TS720 and TS530, all trade names of Cabot Corporation) were added externally, images were formed at ordinary temperature and humidity (25° C.×50%) by means of an image forming apparatus of the type shown in FIG. 1. The specifications of the respective hydrophobic silica grades used and the results of printing 3000 copies are shown in Table 1 below. By using toners to which fine silica particles that had been rendered hydrophobic were added externally in amounts of 0.4 to 1.2 wt %, sharp images that were less fogged and which featured high transfer efficiency could be produced in the initial period of the printing operation. After 3000 copy cycles, sharp images that were less fogged and which featured high transfer efficiency could still be produced when using R972, R974, R202, TS720 and TS530, but when using R812, the transfer efficiency decreased to such a level that the production of sharp images were no longer possible. The toner which had R812 added externally was examined after 3000 copy cycles, and the external additive was found to have been buried in the surface of toner particles. It was therefore apparent that when the commonly used external additives for toners, which are typified by hydrophobic silica, had average sizes of no more than 10 nm for the primary particles, the fogging due to the burial of the external additive increased and the transfer efficiency dropped accordingly as the number of copied prints increased. Obviously, the primary particles in the external additive to be added to the toner should preferably have an average size of at least 10 nm.

TABLE 1

| External additive | Primary particle size (nm) | Agent for rendering hydrophobicity | Fog after 3000 copy cycles | Transferred image after 3000 copy cycles |
|---|---|---|---|---|
| R972 | 16 | silane coupling agent | o | o |
| R972 | 12 | silane coupling agent | o | Δ |
| R202 | 14 | silicone oil | o | o |
| R812 | 7 | silane coupling agent | Δ | x |
| TS720 | 14 | silicone oil | o | o |
| TS530 | 7 | silane coupling agent | Δ | Δ |

Notes: o, good; Δ, no problems in practical use; x, difficult to use.

EXAMPLE 5

Using toners to which 0.4 to 1.2 wt % of various grades of hydrophobic silica (R972, R974, R202 and R812, all trade names of Nippon Aerosil Co., Ltd.: and TS720 and TS530, all trade names of Cabot Corporation) were added externally, images were formed in a cold and dry atmosphere (10° C.×15%) or a hot and humid atmosphere (35° C.×65%) by means of an image forming apparatus of the type shown in FIG. 1.

All toners that were tested satisfied the tolerable level of fog in a cold and dry atmosphere. In a hot and humid atmosphere, the toners to which the external additives were added in amounts of 0.4 to 1.2 wt % satisfied the tolerable level of fog, although there were slight differences depending on the type of hydrophobic silica. However, the toners to which the external additives were added in amounts exceeding 1.2 wt % did not satisfy the tolerable level of fog. All toners to which R202 and TS720 were added externally in amounts of 0.4 to 1.2 wt % satisfied the tolerable level of fog, and they were less fogged less than the toners having the other grades of hydrophobic silica added externally.

EXAMPLE 6

Figure 6:
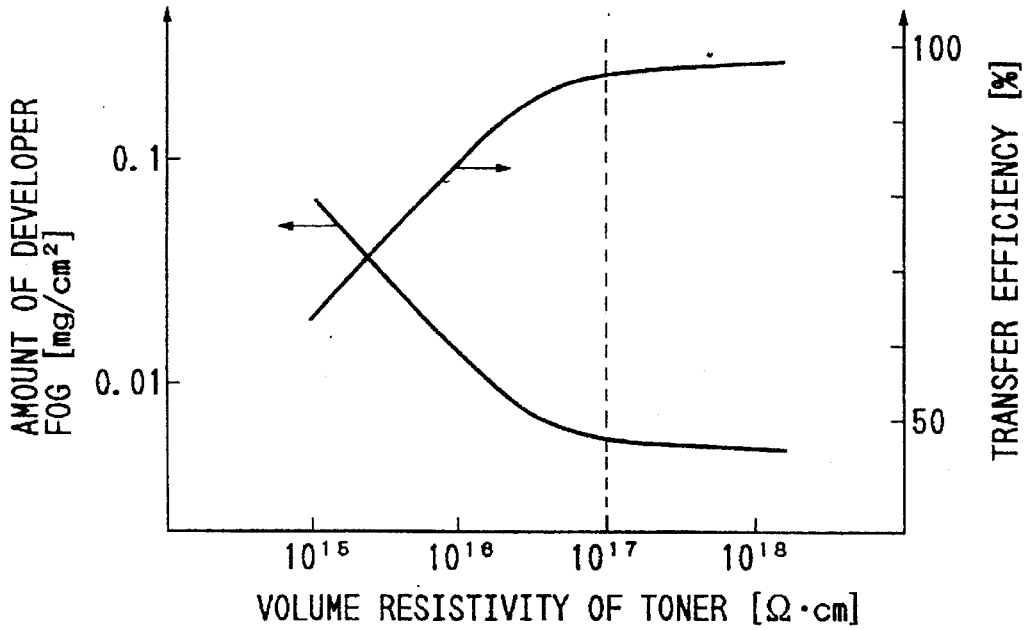
FIG. 6 is a graph showing the relationship among the volume resistivity of toner, the amount of developer fog, and the transfer efficiency as observed in Example 6 of the present invention.

Images were formed using an image forming apparatus of the type shown in FIG. 1. The electric resistance of the toner is an important factor that is necessary to insure that the toner is charged by friction to a predetermined polarity and that there will be no leakage of charges on the toner. It is particularly important that in the impression development and transfer sections, charges should not be injected into the toner in an electric field of 10 V/μm or more and that the polarity of the toner should not be reversed. FIG. 6 shows the relationship among the volume resistivity of the toner, the amount of developer fog, and the transfer efficiency. As one can see from FIG. 6, when the volume resistivity of the toner was $10^{17}$ Ωcm or more, the amount of developer fog could be reduced, and at the same time, the transfer efficiency could be enhanced to 95% and more. As a further advantage, the amount of unwanted residual toner on the latent image carrier was reduced and there was no deposition of the toner or its external additive on the members that had been pressed into contact with the latent image carrier. On the basis of these facts, it was verified that by adjusting the volume resistivity of the toner to $10^{17}$ Ωcm and above, the amount of developer fog could be reduced and, at the same time, the transfer efficiency could be enhanced to 95% and more.

It should be mentioned that the volume resistivity (specific resistance) of the toner was determined by the following method: the toner to be measured was compacted into a pellet having a thickness of 0.5 mm and an electrode was placed on both sides, top and bottom, of the pellet; with a load of 1 kg/cm$^2$ being exerted, a voltage of 250 V was applied to the electrodes and the value of a saturated current in the absence of a charging current was measured and a calculation was made for conversion to the volume resistivity. The measurement was conducted in a nitrogen purged dry desiccator.

EXAMPLE 7

Images were formed using an image forming apparatus of the type shown in FIG. 1.

Figure 10:
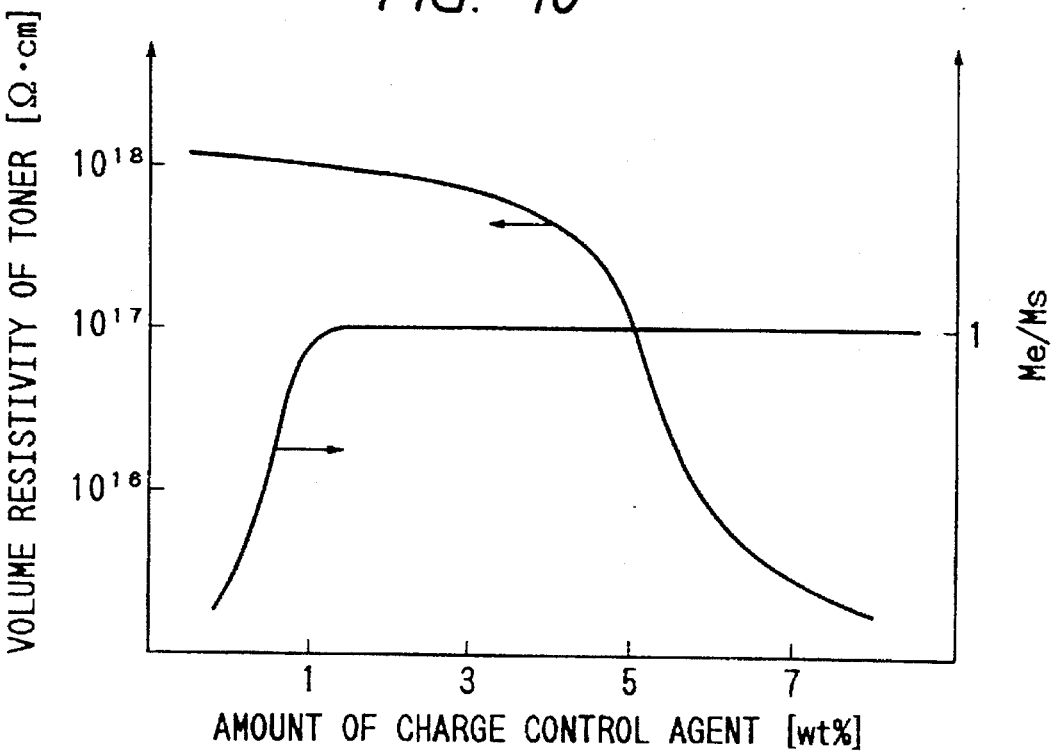
FIG. 10 is a graph showing the relationship among the amount of charge control agent, rapidity in the start of charging, and the volume resistivity of toner as observed in Example 7 of the present invention.

A word must be said here about a charge control agent to be added to the toner. The addition of a charge control agent will improve the startup efficiency of charging the toner, and the difference in image density between the start of printing and the end of printing on one copy is reduced. On the other hand, most of the charge control agents are metal-containing dyes and will unavoidably lower the electric resistance of the toner. The relationship among the amount of charge control agent, the startup efficiency of charging, and the volume resistivity of toner is shown in FIG. 10. To obtain the data shown in the FIG. 10 graph, Me/Ms, or the ratio between the amount of toner (Ms) at the start of development that was conducted to produce a solid black image on A4 paper and the amount of toner (Me) at the end of the development, was used as an index for the startup efficiency of charging. The closer to one (1) the ratio Me/Ms is, the better the startup efficiency of charging. Conversely, the further away from one (1) the ration Me/Ms is, the lower the startup efficiency of charging since this shows a significant difference in the charged state of the toner on its carrier between the start and end of the charging step. In order to produce a state where the difference in images between the start and end points of charging is indistinguishable, Me/Ms must be at least 0.8, desirably at least 0.9. As already mentioned in Example 6, the volume resistivity of the toner must be at least $10^{17}$ Ωcm to insure low developer fog and high transfer efficiency, and to meet this need, a charge control agent is desirably added internally in an amount of no more than 5 wt %. Further, in order to produce a state where the difference in image density between the start and end points of printing on one copy is indistinguishable, the charge control agent must be added in an amount of at least 1 wt %. In the light of these facts, the charge control agent was incorporated in amounts of 1 to 5 wt %, and that the result was the difference in image density between the start and end points of printing was indistinguishable and that images could be formed with low developer fog and in high transfer efficiency. Thus, it was verified that by adjusting the amount of charge control agent to lie within the range from 1 to 5 wt %, the volume resistivity of the toner could be insured at values of $10^{17}$ Ωcm and above Furthermore, images could be formed with uniform image density, reduced developer fog, and with reduced occurrence of incomplete transfer.

EXAMPLE 8

Using toners that had charge control agents of various grades (Bontron S-34, trade name of Orient Chemical Industry Co., Ltd.; AIZEM Spiron Black T-95 and T-77, all trade names of Hodogaya Chemical Co., Ltd.; Kayacharge N-3 and T-2, all trade names of Nippon Kayaku Co., Ltd.) incorporated in matrix resin particles in amounts of 1 to 5 wt %, images were formed by means of an image forming apparatus of the type shown in FIG. 1. With all toners, sharp images featuring low fog and high transfer efficiency could be produced, without any difference in image density between the start and end points of printing on one copy. Using toners that incorporated 7 wt % of the above-identified charge control agents in matrix resin particles, images were formed by means of an image forming apparatus of the type shown in FIG. 1. In that case, the volume resistivity of the toners dropped to values between about $10^{15}$ and $10^{16}$ Ωcm. All toners produced images that had no difference in density between the start and end points of printing on one copy, but, fogging and failure in images transfer occurred and no sharp image could be produced.

EXAMPLE 9

Images were formed using an image forming apparatus of the type shown in FIG. 1.

Figure 11:
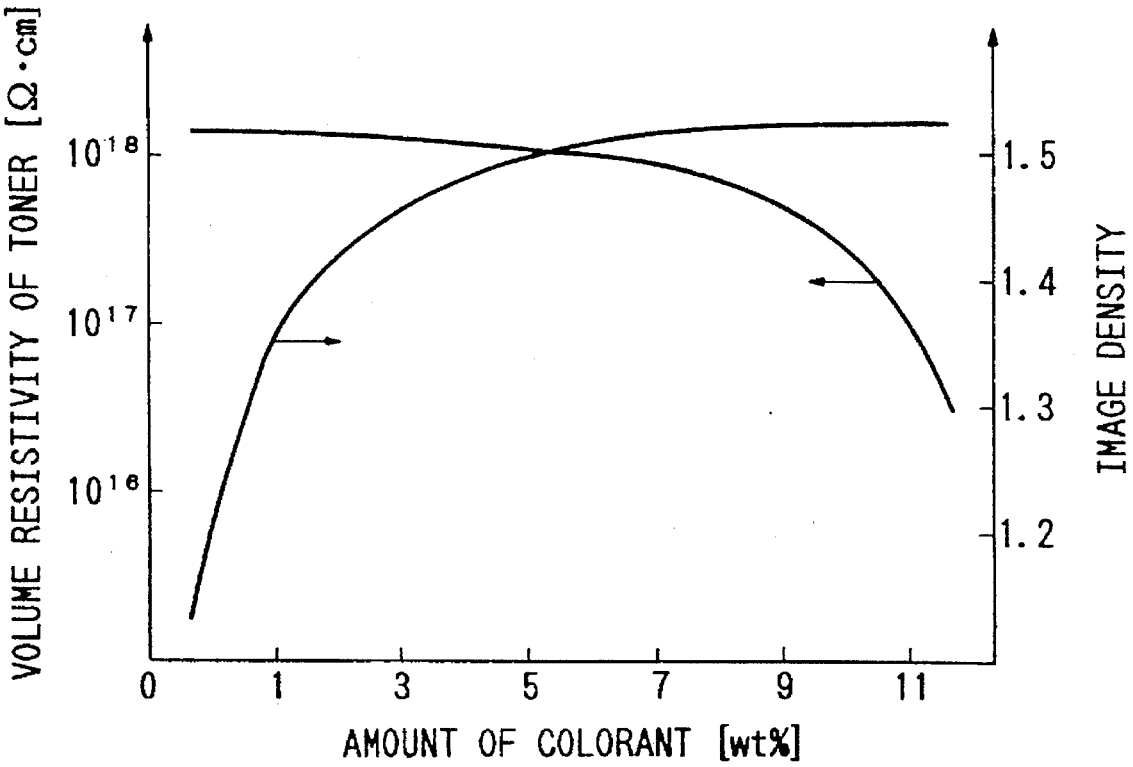
FIG. 11 is a graph showing the relationship among the amount of colorant, the density of image, and the volume resistivity of toner as observed in Example 9 of the present invention.

A word must be said about a colorant to be added to the toner. Carbon black and other colorants that are commonly used to color the toner have the disadvantage of lowering its electric resistance. The relationship among the amount of colorant, the volume resistivity of the toner, and the image density obtained is shown in FIG. 11. As it turned out, the colorant must be added in an amount of at least 0.5 wt % of matrix resin particles in order to attain an image density of 1.2 and more, and to attain an image density of 1.4 and more, the colorant has to be added in an amount of at least 1 wt %. In order to insure that the toner has a volume resistivity of at least $10^{17}$ Ωcm, the colorant is desirably incorporated in an amount not exceeding 10 wt %. On the basis of these facts, the colorant was incorporated in amounts of 0.5 to 10 wt %. As a result, an images density of 1.2 was attained and image could be formed with low developer fog and in high transfer efficiency. When the colorant was incorporated in amounts of 1 to 10 wt %, an images density of 1.4 was attained and image could also be formed with low developer fog and in high transfer efficiency. In the light of these facts, it was verified that in order to reduce the developer fog and to enhance the transfer efficiency, the colorant is preferably incorporated in the matrix resin particles of toner in amounts of 1 to 10 wt %.

EXAMPLE 10

Using toners that incorporated 0.5 wt % of carbon black (PRINTEX of DEGUSSA or MOGUL of Cabot Corporation) in matrix resin particles, images were formed by means of an image forming apparatus of the type shown in FIG. 1. Whichever toner was used, a sharp image having a density of ca. 1.2 was produced without any fog and in high transfer efficiency. A similar experiment was conducted using toners having PRINTEX or MOGUL incorporated in an amount of 1 wt % of matrix resin particles in order to form images with an image forming apparatus of the type shown in FIG. 1. Whichever toner was used, a sharp image having a density of at least 1.4 was produced without any fog and in high transfer efficiency. Another experiment was run using toners having PRINTEX or MOGUL incorporated in an amount of 10 wt % of matrix resin particles in order to form images with an image forming apparatus of the type shown in FIG. 1. Whichever toner was used, a sharp image having an image density of at least 1.4 was produced without any fog and in high transfer efficiency. Still another experiment was conducted using toners having PRINTEX or MOGUL incorporated in an amount of 12 wt % of matrix resin particles in order to form images with an image forming apparatus of the type shown in FIG. 1. Whichever toner was used, an image was produced having an image density of at least 1.4. However, the volume resistivity of the toners dropped to about $10^{16}$ Ωcm, and fogging and failure in image transfer occurred, making it impossible to produce a sharp image.

EXAMPLE 11

Images were formed using an image forming apparatus of the type shogun in FIG. 1.

A word must be said about a release agent to be incorporated in the toner. The release agent to be incorporated in the toner is important for the purpose of enhancing the ability of the toner to resist offsetting during fixing. However, if the toner is held in continued pressure contact in the development section, transfer section, or cleaning section, the release agent will bleed out and stick to the latent image carrier or developing member to cause filming. The filming of the release agent is most likely to occur in the case where polyester-base toners are used because the release agent is often immiscible and because the probability with which the matrix particles of the toner will make direct contact with the latent image carrier or other members will increase if the amount of incorporation of the release agent is reduced. It should, however, be noted that the same phenomenon was found to occur with other toner resins.

Figure 7:
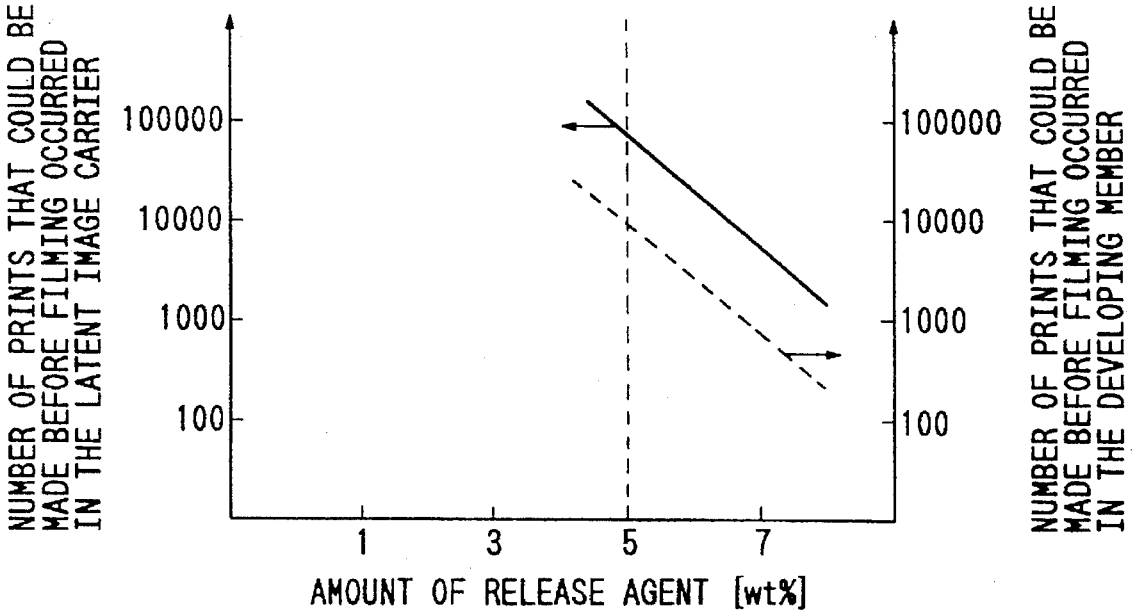
FIG. 7 is a graph showing the relationship among the amount of release agent incorporated in the matrix resin particles of toner, and the numbers of prints that could be made before filming occurred in the latent image carrier, and the developing member in Example 11 of the present invention.

FIG. 7 shows the relationship among the amount of release agent to be incorporated in the matrix resin particles of toner, the numbers of prints that could be made before filming occurred in the latent image carrier 1 and the developing member. When the release agent was incorporated in the matrix resin particles in amounts of no more than 5 wt %, the filming of the toner on the developing member or latent image carrier could be effectively prevented to extend the life of the apparatus and improve its operational reliability. When the release agent was incorporated in the matrix resin particles in amounts of no more than 3 wt %, the life of the impression development member 11, latent image carrier 1 and the impression cleaning member 23 could be extended to approach the designed life of the apparatus, and there was no need to discard these members which were conventionally adapted to be disposable in order to prevent the drop in the operational reliability of the apparatus. Verification was also made of the relationship between the amount of release agent and the "white void" in the image that was transferred onto the recording medium. The "white void" in the transferred image is the missing of some areas from the toner image, and this phenomenon occurs when an adhesion between the toner and the latent image carrier blocks transfer of the toner onto the recording medium. In an extreme case, a very strong part of the adhesion will not be transferred at all, thus forming white spots in the final image. "White void" is most likely to occur when great pressure is applied during image transfer. Stated more specifically, white void tends to occur if the pressure which the transfer member applies to the latent image carrier is unduly great or if a thick sheet of paper is used as the recording medium. Therefore, white void can be reduced by increasing the amount of the release agent in the toner to such an extent that the cohesion between toner particles is sufficiently enhanced to overcome the force by which the toner adheres to the latent image carrier. The relationship between the amount of release agent in the toner and the occurrence of white void is shown in Table 2 below. In order to reduce the occurrence of white in the transferred image, the release agent has to be incorporated in toner's matrix resin particles in an amount of at least 1 wt %, desirably at least 2 wt %. On the basis of these facts, it was verified that by adjusting the amount of release agent to lie within the range from 1 to 5 wt %, preferably from 2 to 5 wt %, not only could the filming of the toner be prevented but also the white void in the transferred image could be prevented.

TABLE 2

| Release agent | Amount of release agent, wt % | White void |
|---|---|---|
| A | 0.5 | x |
| A | 1.0 | Δ |
| A | 2.0 | o |
| A | 3.5 | o |
| A | 5.0 | o |
| A | 10.0 | o |
| B | 1.0 | Δ |
| B | 2.0 | o |
| C | 3.0 | o |

Notes:
A, low-molecular weight polypropylene
B, low-molecular weight polyethylene
C, carnauba wax
o, no white void
Δ, some white void (but no problems in practical use)
x, positive white void

EXAMPLE 12

Images were formed using an image forming apparatus of the type shown in FIG. 1.

A word must be said about the shape factor of the toner. As the resolving power of an existing image forming apparatus increases, efforts are being made to reduce the volume average particle size of the toner. In order to achieve areal halftoning by a concentrated gray scale equivalent to 300 DPI, fine toners having a volume average particle size of about 12 μm are necessary whereas, in order to achieve areal halftoning by a concentrated gray scale equivalent to 600 DPI, fine toners having a volume average particle size of no more than 10 μm are necessary. This also holds true with an image forming apparatus that has a contact charging member 4, an impression development member 11, an impression transfer member 18 and an impression cleaning member 23. Also, in order to form an image that is equivalent to 600 DPI in density, not only is it necessary to achieve a higher image resolution by establishing contact in each of the steps mentioned above, but it is also required to reduce the volume average particle size of the toner to be within the range 6 to 10 μm. In fact, however, while an attempt to reduce the particle size of the toner widened its size distribution and fogging, the dusting of the toner and streaking occurred because tiny particles passed uncaptured by various areas of impression or they were poorly charged and coarse particles clogged various areas of impression. The relationship among the volume average particle size of toner, its size distribution, halftoning (gray scale), fog, and filming is shown in Table 3 below. A review on the grain size distribution of the toner showed the following: when the number percentage of toner particles not larger than 5 μm was adjusted to 15% and less and when the number percentage of toner particles of at least 12.7 μm in size was adjusted to no more than 5%, the toners could be prevented not only from passing uncaptured by various areas of impression but also from clogging or causing filming in those areas of impression; further, the developer fog due to poorly charged toner particles was reduced; and the transfer efficiency improved to insure consistent formation of high-resolution images. In order to prepare toners having this preferred grain size distribution, strict conditions had to be met by toner screening, and, at the same time, both oversized and undersized particles had to be cut off. As a result, the yield of the toner decreased to some extent, but, on the other hand, the increase in the cost of the toner could be held low by recycling rejected toner particles for further pulverizing and screening.

TABLE 3

| Volume average grain size, μm | Grains of 5 μm and less, number % | Grains of 12 μm and more, number % | Half-toning | Fog | Filming |
|---|---|---|---|---|---|
| 5.3 | 13.3 | 1.2 | o | x | x |
| 6.2 | 12.5 | 1.5 | o | Δ | Δ |
| 6.3 | 16.5 | 0.7 | o | x | x |
| 7.8 | 10.0 | 2.0 | o | o | o |
| 8.5 | 9.5 | 2.3 | o | o | o |
| 8.7 | 9.0 | 6.2 | x | o | o |
| 8.9 | 17.0 | 4.0 | Δ | x | x |
| 9.1 | 8.7 | 0.8 | o | o | o |
| 9.8 | 7.8 | 1.5 | o | o | o |
| 11.3 | 9.3 | 7.3 | x | o | o |

Notes: o, good; Δ, no problems in practical use; x, difficult to use.

The toners to be used in the present invention comprise the following ingredients (1) to (5) as essentials (in the case of non-magnetic toner) and they further contain ingredient (6) if they are magnetic toners. The toners, whether they are magnetic or non-magnetic, may be manufactured by the pulverization or polymerization method.

(1) Binder resin

Styrenic resins such as polystyrene, styrene-acrylic acid copolymer, styrene-methacrylic acid copolymer, styrene-acrylate ester copolymer, and styrene-butadiene copolymer; saturated polyester resins; unsaturated polyester resins; epoxy resins; phenolic resins; maleic acid resins; coumaric acid resins; chlorinated paraffin containing xylene resins; vinyl chloride resins; polypropylene; polyethylene; and mixtures of two or more of these resins.

(2) Colorant

Carbon black, lamp black, iron black, ultramarine, nigrosine dyes, monoazo dyes, disazo dyes, trisazo dyes, oil black, azo oil black, and mixtures of two or more of these colorants.

(3) Fluidizer (external additive)

Inorganic oxides such as $SiO_2$, $TiO_2$ and $Al_2O_3$ that have been rendered hydrophobic on the surface; fine inorganic particles such as those of SiC; metal soaps such as zinc stearate; and mixtures of two or mote of these colorants.

(4) Release agent

Synthetic waxes such as low-molecular weight polyethylene and polypropylene; plant-derived waxes such as candelilla wax, carnauba wax, rice wax, Japan wax, and jojoba wax; animal-derived waxes such as beeswax, lanolin, and whale wax; mineral-derived waxes such as montan wax and ozokerite; oleaginous waxes such as hardened castor oil, hydroxystearic acid, aliphatic amides, and phenolic aliphatic acid esters; and mixtures of two or more of these waxes.

(5) Charge control agent

If the toner of interest is to be positively charged, an electron donating substance is used as selected from among nigrosine dyes, metal salts of aliphatic acids, quaternary ammonium salts, benzothiazole derivatives, guanamine derivatives, dibutyltin oxide, and nitrogenous compounds.

If the toner of interest is to be negatively charged, an electron accepting substance is used as selected from among azo and other metal-containing dyes, metal complexes of chlorinated paraffin, chlorinated polyesters or alkyl salicylic acids, metal complexes of dicarboxylic acid, and metal salts of polycyclic salicylic acid.

(6) Magnetic powder

Magnetic materials containing at least one element selected from among Fe, Ni, Co, Cr, and Mn, as exemplified by $\gamma$-$Fe_2O_3$, BaO-6$Fe_2O_3$, Ni—Co, Co—Cr, and Mn—Al can be used.

While several examples of the present invention have been described above, the image forming method of the invention is basically of a type that includes steps wherein a toner 10, whether it is magnetic or nonmagnetic, is pressed into contact with the latent image carrier 1 (those steps are charging, development, transfer and cleaning), and it is characterized as to whether a high-resolution image can be formed consistently by satisfying any one of the following requirements: the amount of an external additive in the toner be adjusted to lie within the specified range; the electric resistance of the toner be adjusted to no less than the specified value; the amount of a release agent in the toner be adjusted to lie within the specified range; or the grain size distribution of the toner be adjusted to lie within the specified range. Iftwo or more of these conditions are met simultaneously, images of even higher resolution can be formed consistently. It should be noted that the applicability of the present invention is in no way limited to the case of Examples 1 to 12 described hereinabove, but it is applicable to a wide range of image forming apparatus that rely upon various electrophotographic processes, and particularly good results can be achieved if the method of the invention is applied to printers, copiers, facsimile and displays.

As described on the foregoing pages, the present invention offers the advantage of providing an image forming method by which the deposition or filming of toner particles on various impression members is sufficiently reduced to enable the consistent formation of high-resolution images and which is substantially free from the problem of fluctuations in the charges on the toner in various areas of impression. Therefore, the likelihood of deterioration in image quality such as fogging is reduced. The invention offers another advantage in that it provides an image forming method that is so much improved in the reliability of the steps of charging, development, transfer, and cleaning that it can be implemented with a compact and long-lived image forming apparatus.

According to the first image forming method of the present invention, which includes the steps of contact charging and contact transfer, the toner has an external additive added to the matrix resin particles in an amount of 0.4 to 1.6 wt %, thereby imparting a desired degree of fluidity to the toner. Since the chance of a malfunction of the charging member is sufficiently reduced to prevent uneven charging, fogging is suppressed and the transfer efficiency is sufficiently increased not only to reduce the frequency of incomplete toner transfer but also to eliminate the occurrence of defective transfer. Consequently the formation of high-resolution images is insured.

In a preferred embodiment of this method, which includes the steps of contact charging, impression development, and contact transfer, the external additive is added to the matrix resin particles in an amount of 0.4 to 1.2 wt %. This is effective in reducing the deposition of the external additive on the impression development member. As a result, the occurrence of toner particles of reverse polarity is effectively prevented to reduce the chance of deterioration in image quality due to fogging or the back-side scum which would otherwise occur during toner transfer.

According to the second image forming method of the present invention, the electric resistance of the toner is sufficiently enhanced so that it will not lose charges but will maintain a predetermined polarity even if it is placed in a high electric field during impression development or impression transfer. As a result, both development efficiency and transfer efficiency are enhanced, whereby the occurrence of fogging during development and dusting of the toner during transfer are sufficiently reduced to insure the consistent formation of high-resolution images.

According to the third image forming method of the present invention, the amount of the release agent incorporated in the toner is controlled to be within a predetermined range and this not only prevents the filming of toner which would otherwise occur in various parts of impression but also suppresses the "white void" which would otherwise occur in the transfer step, whereby high-resolution images can be formed in a consistent manner.

According to the fourth image forming method of the present invention, the particle size distribution of the toner is rendered sharp enough to reduce the occurrence of tiny or coarse toner particles. This insures that no toner particles will pass uncaptured in various areas of impression while preventing the occurrence of toner clogging or filming in those areas of impression. At the same time, the developer fog which would otherwise occur due to poorly charged toner particles is reduced and the transfer efficiency is sufficiently improved to insure consistent formation of high-resolution images.

What is claimed is:

1. An image forming method, comprising:

charging a latent image carrier to a predetermined potential via a contact charging member;

exposing said latent image carrier to light to form a latent electrostatic image;

developing said latent electrostatic image by imparting a toner to said latent image to render it visible;

pressing an impression transfer member into contact with said latent image carrier to transfer developed toner to a recording medium, said toner being comprised of matrix resin particles having an external additive in an amount of 0.4 to 1.6 wt %; and pressing a cleaning member into contact with said latent image carrier to remove toner remaining on said carrier after said transfer.

2. A method according to claim 1, wherein said developing step is performed by pressing said developing member into contact with said latent image carrier, and wherein said external additive in said toner is present in an amount of 0.4 to 1.2 wt %.

3. A method according to claim 1, wherein said external additive comprises hydrophobic silica having an average primary particle size of at least 10 nm.

4. A method according to claim 2, wherein said toner has a volume resistivity of at least $10^{17}$ ohm-cm.

5. A method according to claim 2, wherein said toner includes a release agent in an amount ranging from 1 to 5 wt %.

6. A method according to claim 1, wherein said toner has a volume average particle size of 6 to 10 μm, with the percentage of toner particles not larger than 5 μm being no more than 15% of said toner particles, and the percentage of toner particles not smaller than 12.7 μm being no more than 5% of said toner particles.

7. An image forming method, comprising:

charging a latent image carrier to a predetermined potential;

exposing said latent image carrier to light to form a latent electrostatic image;

developing said latent electrostatic image by pressing an impression developing member into contact with said latent image carrier to impart a toner to said latent image to render it visible; and pressing an impression transfer member into contact with said latent image carrier to transfer developed toner to a recording medium, said toner having a volume resistivity of at least $10^{17}$ ohm-cm.

8. A method according to claim 7, wherein said toner is comprised of matrix resin particles having a charge control agent additive in an amount ranging from 1 to 5 wt %.

9. A method according to claim 7, wherein said toner is comprised of matrix resin particles having a colorant additive in an amount ranging from 1 to 10 wt %.

10. A method according to claim 7, wherein said toner is comprised of matrix resin particles having a release agent additive in an amount ranging from 1 to 5 wt %.

11. A method according to claim 7, wherein said toner has a volume average particle size of 6 to 10 μm, with the percentage of toner particles not larger than 5 μm being no more than 15% of said toner particles, and the percentage of toner particles not smaller than 12.7 μm being no more than 5% of said toner particles.

12. An image forming method, comprising:

charging a latent image carrier to a predetermined potential;

exposing said latent image carrier to light to form a latent electrostatic image;

developing said latent electrostatic image by pressing an impression developing member into contact with said latent image carrier to impart a toner to said latent image to render it visible; and transferring developed toner to a recording medium; and pressing a cleaning member into contact with said latent image carrier to remove toner remaining on said carrier after said transfer, wherein said toner is comprised of matrix resin particles having a release agent additive in an amount ranging from 1 to 5 wt %.

13. A method according to claim 12, wherein said toner has a volume average particle size of 6 to 10 μm, with the percentage of toner particles not larger than 5 μm being no more than 15% of said toner particles, and the percentage of toner particles not smaller than 12.7 μm being no more than 5% of said toner particles.

14. An image forming method, comprising:

contacting a charging member to a latent image carrier to charge the latent image carrier to a predetermined potential;

exposing said latent image carrier to light to form a latent electrostatic image;

developing said latent electrostatic image by pressing a developing member into contact with said latent image carrier to impart a toner to said latent image to render it visible;

pressing an impression transfer member into contact with said latent image carrier to transfer developed toner to a recording medium; and pressing a cleaning member into contact with said latent image carrier to remove toner remaining on said carrier after said transfer, wherein said toner has a volume average particle size of 6 to 10 μm, with the percentage of toner particles not larger than 5 μm being no more than 15% of said toner particles, and the percentage of toner particles not smaller than 12.7 μm being no more than 5% of said toner particles.

* * * * *